US009038523B2

(12) United States Patent
Rasico et al.

(10) Patent No.: US 9,038,523 B2
(45) Date of Patent: May 26, 2015

(54) VEHICLE FLOOR

(71) Applicant: International Truck Intellectual Property Company, LLC, Lisle, IL (US)

(72) Inventors: James G. Rasico, Farmington, MI (US); Gordon J. Wolverton, Lake Orin, MI (US); Paul R. Pasternak, Sterling Heights, MI (US); Timothy Oselett, St. Clair Shores, MI (US); Craig Alan Newman, East Lansing, MI (US); David M. Gerst, Fort Wayne, IN (US); Jeffrey A. Mears, Chandler, AZ (US); Joseph A. Calash, Batavia, IL (US)

(73) Assignee: International Truck Intellectual Property Company, LLC, Lisle, IL (US)

( * ) Notice: Subject to any disclaimer, the term of this patent is extended or adjusted under 35 U.S.C. 154(b) by 32 days.

(21) Appl. No.: 13/965,387

(22) Filed: Aug. 13, 2013

(65) Prior Publication Data

US 2014/0202323 A1 Jul. 24, 2014

Related U.S. Application Data

(60) Provisional application No. 61/693,059, filed on Aug. 24, 2012.

(51) Int. Cl.
*F41H 5/06* (2006.01)
*F41H 7/04* (2006.01)

(52) U.S. Cl.
CPC ..... *F41H 7/042* (2013.01)

(58) Field of Classification Search
CPC ..... F41H 5/013; F41H 5/06; F41H 5/02; F41H 5/04; F41H 5/14; F41H 7/042; F41H 7/04; F41H 7/00; F41H 7/02; F41H 7/048
USPC ..... 89/36.01, 36.02, 36.07, 36.08; 280/784; 296/189
See application file for complete search history.

(56) References Cited

U.S. PATENT DOCUMENTS

| | | | | |
|---|---|---|---|---|
| 5,747,721 | A * | 5/1998 | Speakes et al. | 89/36.11 |
| 7,997,182 | B1 * | 8/2011 | Cox | 89/36.09 |
| 8,418,594 | B1 * | 4/2013 | Dunne et al. | 89/36.02 |
| 8,601,931 | B2 * | 12/2013 | Naroditsky et al. | 89/36.08 |
| 8,616,617 | B2 * | 12/2013 | Sherbeck et al. | 296/187.07 |

(Continued)

FOREIGN PATENT DOCUMENTS

GB 1314599.0 8/2013

*Primary Examiner* — Benjamin P Lee
(74) *Attorney, Agent, or Firm* — Jeffrey P. Calfa; Mark C. Bach

(57) ABSTRACT

Blast absorbing structures and system for use in absorbing blast forces exerted on a floor of a personnel cabin of a vehicle, are disclosed. The blast absorbing flexing structure comprises a bottom section forming a floor of the cabin, a first side section and opposing second side section, each side section extending from the bottom section and including a plurality of steps along a length of the second side section. The steps flex in response to a blast force. In another embodiment, the blast absorbing expanding structure comprises a force abatement device forming a floor of the cabin, a cover plate having a plurality of slots arranged around a perimeter of the plate. The cover plate is movable between a neutral position and a blast force position to diminish the blast forces prior to the blast forces to reaching an occupant of the cabin.

5 Claims, 12 Drawing Sheets

(56) References Cited

U.S. PATENT DOCUMENTS

| | | | | |
|---|---|---|---|---|
| 8,671,819 | B2 * | 3/2014 | Dunne et al. | 89/36.02 |
| 8,746,741 | B2 * | 6/2014 | Gonzalez | 280/784 |
| 8,844,970 | B2 * | 9/2014 | Gras et al. | 280/784 |
| 2009/0140545 | A1 * | 6/2009 | Greuter et al. | 296/187.07 |
| 2010/0218667 | A1 * | 9/2010 | Naroditsky et al. | 89/36.02 |
| 2011/0197744 | A1 * | 8/2011 | Cox | 89/36.02 |
| 2011/0277621 | A1 * | 11/2011 | Joynt | 89/36.02 |
| 2012/0049570 | A1 * | 3/2012 | Aizik | 296/187.08 |
| 2012/0097019 | A1 * | 4/2012 | Sherbeck et al. | 89/36.02 |
| 2012/0111181 | A1 * | 5/2012 | Brill et al. | 89/36.08 |
| 2012/0174767 | A1 * | 7/2012 | Naroditsky et al. | 89/36.08 |
| 2012/0186428 | A1 * | 7/2012 | Peer et al. | 89/36.02 |
| 2013/0319215 | A1 * | 12/2013 | Parida et al. | 89/36.02 |
| 2014/0026741 | A1 * | 1/2014 | Dunne et al. | 89/36.02 |
| 2014/0130658 | A1 * | 5/2014 | Gonzalez | 89/36.08 |
| 2014/0150633 | A1 * | 6/2014 | Mears et al. | 89/36.02 |
| 2014/0182449 | A1 * | 7/2014 | Mears et al. | 89/36.08 |
| 2014/0311330 | A1 * | 10/2014 | Parida et al. | 89/36.08 |
| 2014/0318357 | A1 * | 10/2014 | Parida et al. | 89/36.02 |
| 2014/0318359 | A1 * | 10/2014 | Asaf et al. | 89/36.08 |
| 2014/0318360 | A1 * | 10/2014 | Peer et al. | 89/36.08 |

* cited by examiner

VEHICLE FLOOR

CROSS-REFERENCE TO RELATED APPLICATIONS

This application claims the benefit of U.S. Provisional Patent Application Ser. No. 61/693,059 filed on Aug. 24, 2012.

TECHNICAL FIELD

The present disclosure relates to a blast absorbing structure and system for use in decreasing the extent of catastrophic injury to the occupants of a vehicle, including a military vehicle subjected to a blast. More specifically, the structure and system absorbs the energy from a blast before it reaches the lower extremities of the occupants in the vehicle cabin.

BACKGROUND

Armored vehicles are frequently threatened by improvised explosive devices (IEDs) designed to cause harm to the vehicle and its occupants. IEDs are typically one or more grouped artillery shells redeployed and detonated in an effort to inflict casualties. These explosive devices when detonated beneath a floor of a vehicle, often create localized deformation of the floor of the vehicle thereby transmitting large vertical loads onto the lower extremities of occupants of the vehicle. For example, detonations below the underbelly of an armored vehicle may cause the vehicle floor to accelerate at 100 G or more and reach velocities of 7 to 12 m/s over a time period of 3 to 5 msec. These high rates of acceleration and velocity transmit large mechanical forces on the lower extremities of the occupants within the vehicle cabin, often resulting in catastrophic injury or worse.

Armor countermeasures typically consist of heavy metal plates placed between the threat and the vehicle in such a way as to resist hull breach and aggressive floor accelerations. These heavy metal plates also work in concert with layers of additional metal, ceramic, composite or plastic materials designed to prevent lethal high velocity fragments from entering the vehicle. The heavy metal plates are typically mounted to the underside of the vehicle in shapes to take advantage of venting efficiency, inherent geometric stiffness, and deflection characteristics when presented with incoming pressure and fragmentation. Carrying a heavy blast and fragment resistant hulls results in significant performance disadvantage to the vehicle in terms of reduced fuel economy, lost cargo capacity and increased transportation shipping costs.

In addition to the outer metal plates, the interior of the personnel cabin may include a blast mat. During a blast event on an armored vehicle, the lower extremities of the occupants of the vehicle are frequently subjected to injuries from the blast energy being transmitted through the vehicle structure. One current solution to dissipate the energy is to use blast mats where the occupants of the vehicle rest their feet. However, current blast mats are expensive and heavy, often contributing unwanted additional weight to an already heavy vehicle.

Therefore, there is a need for an efficient, cost-effective energy absorbing structures and systems for use during a high acceleration event, such as a blast event underneath the vehicle. The present structures and system are usable, for example, in a personnel cabin of a vehicle, specifically as an interior structure or floor, and includes an energy absorbing structure for absorbing and dissipating the blast forces from an explosive device, thereby lessening the impact of the forces on the lower extremities of the occupants of the vehicle. One such blast absorbing structure includes a stepped floor design, having a bottom section and side sections incorporating a plurality of steps or ridges. In another embodiment, the blast absorbing structure includes a blast abatement structure assembly having an expandable-style floor plate. Energy absorbing supports may also be used in connection with the blast absorbing structures creating a "floating floor" to improve the absorption and dissipation of forces exerted on the underbelly of the vehicle during a blast event, while avoiding the negative tradeoffs of alternative designs.

SUMMARY

There is disclosed herein a structure and assembly, each of which avoids the disadvantages of prior structures and devices while affording additional structural and operating advantages.

Generally speaking, a blast absorbing structure and system for use in absorbing blast forces exerted on a floor of a personnel cabin of a vehicle are disclosed.

In an embodiment, a blast absorbing flexing structure for use in absorbing blast force energy exerted on an underside of a personnel cabin of a vehicle, is disclosed. The blast absorbing flexing structure comprises a bottom section forming a floor of the cabin, a first side section extending from the bottom section, the first side section having a plurality of steps along a length of the first side section, a second side section extending from the bottom section and opposite to the first side section, the second side section having a plurality of steps along a length of the second side section, wherein the bottom and side sections form an absorption component cooperatively movable between an initial position and a blast force position to diminish the blast forces prior to the blast forces to reaching an occupant of the cabin.

In another embodiment, a blast absorbing expanding structure for use in absorbing blast force energy exerted on an underside of a personnel cabin of a vehicle, is disclosed. The blast absorbing expanding structure comprises a blast abatement device forming a floor of the cabin, a cover plate having a plurality of slots arranged around a perimeter of the plate, the cover plate attached to a top surface of the device, and wherein the cover plate is movable between an initial position and a blast force position to diminish the blast forces prior to the blast forces to reaching an occupant of the cabin.

In yet another embodiment, a blast absorbing movable structure for use in absorbing blast force energy exerted on an underside of a personnel cabin of a vehicle, is disclosed. The blast absorbing movable structure comprises a blast abatement device forming a floor of the cabin, a protective panel positioned over the device, and a plurality of energy absorbing slots arranged within the cover, wherein the panel is movable between a neutral position and a blast force position upon application of the blast force on the underside of the cabin and dissipation of blast force energy through the slots.

These and other features and advantages of the present structure and assembly can be more readily understood from the following detailed discussion with reference to the appended drawing figures.

DETAILED DESCRIPTION

Referring to FIGS. 1-14, there is illustrated exemplary embodiments of blast energy absorbing structures, generally designated by the numerals 10, 100, as well as the components thereof. The structures 10, 100 are designed for use as a blast energy absorbing system on the cabin hull (not shown) of a personnel cabin (not shown) of a vehicle (not shown). The blast energy absorbing structures are particularly useful on military vehicles, which are used in war-zones for transporting personnel or cargo. The structures 10, 100 will absorb energy from a blast, thus lessening the impact on the vehicle occupants' lower extremities, which rest on the structure, thereby reducing injury to the occupants.

Figure 8B:
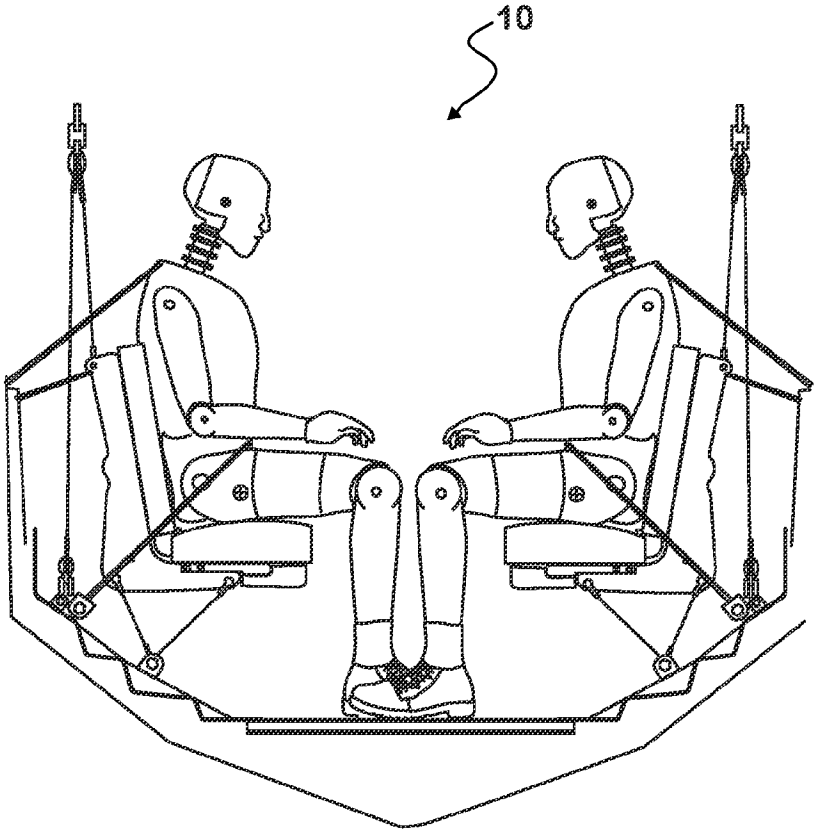
FIGS. 8*a* and 8*b* are side views of the blast absorbing flexing structure in pre-blast position.
Figure 8A:
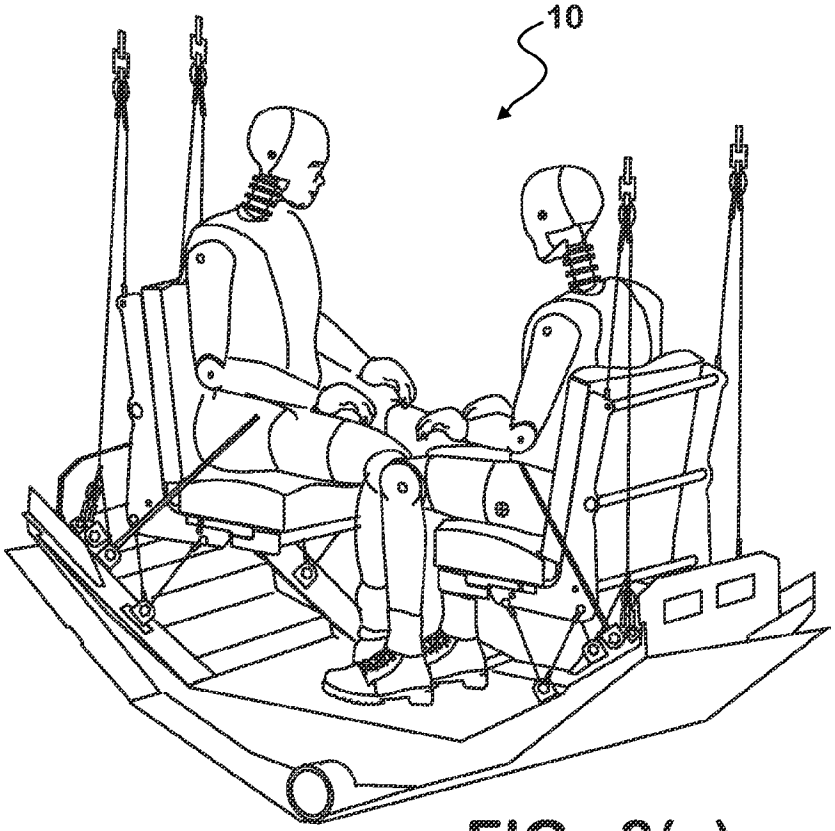
Figure 9B:
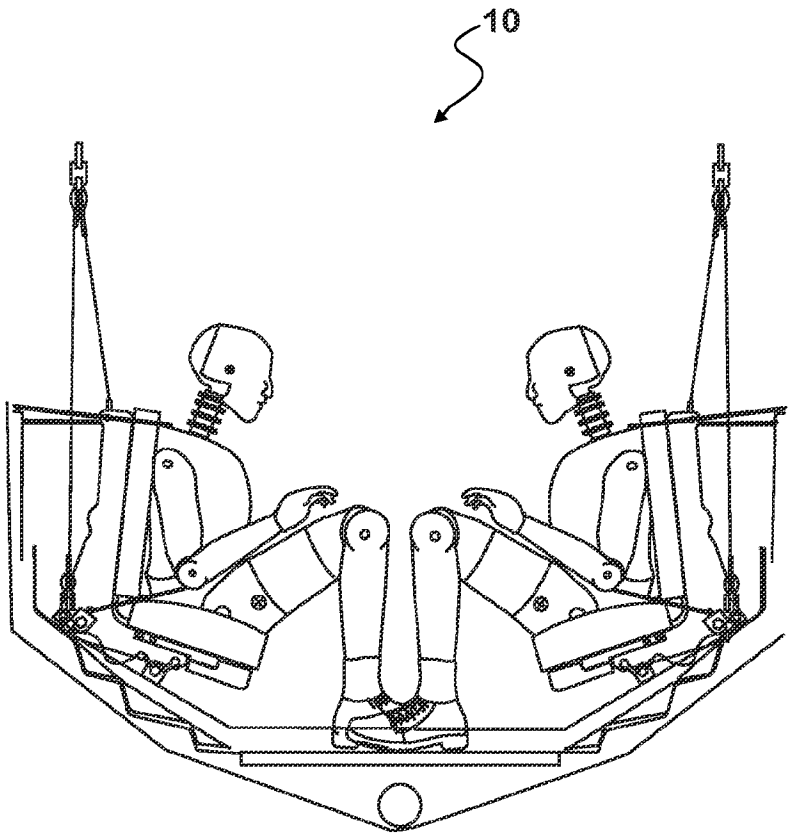
FIGS. 9*a* and 9*b* are side views of the blast absorbing flexing structure in a post-blast position.
Figure 9A:
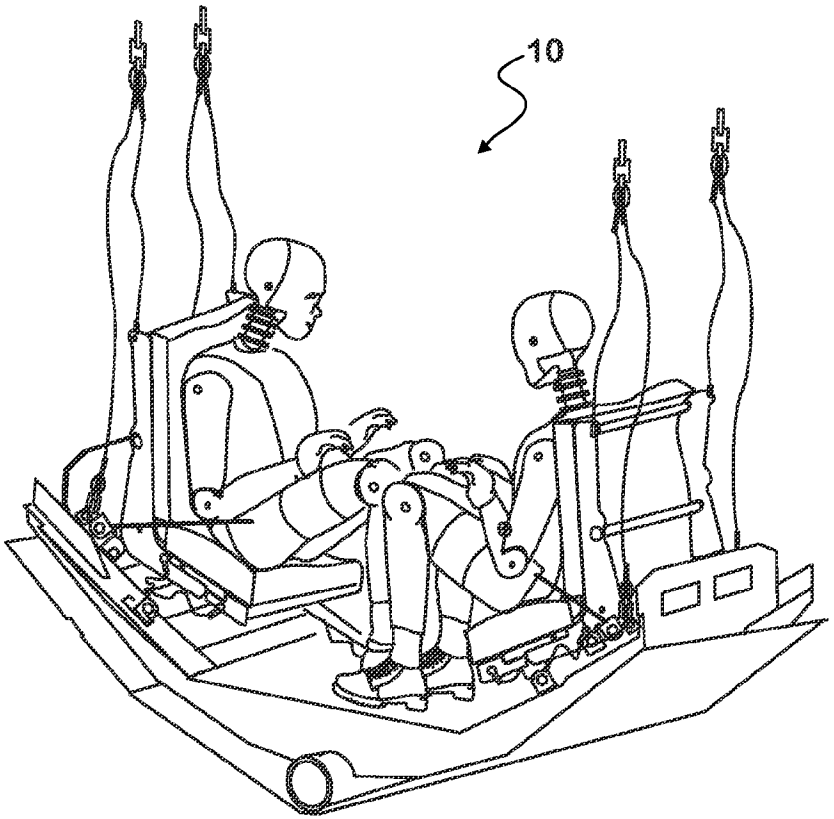

One embodiment of the blast energy absorbing structure, specifically a blast absorbing flexing structure 10 is shown in FIGS. 1-7. In addition, FIGS. 8*a*-8*b* show the blast absorbing flexing structure 10 in a pre-blast or neutral position, while FIGS. 9*a*-9*b*, show the structure in a post-blast or activated position. The blast structure 10 includes a bottom section 12, generally horizontal, which forms the floor of the cabin. The structure also includes a first side section 14 and a second side section 16, opposed from one another and connected to the bottom section. Each side section 14, 16 includes a plurality of ridges or steps 18 along a length of the section.

Figures 1, 2:
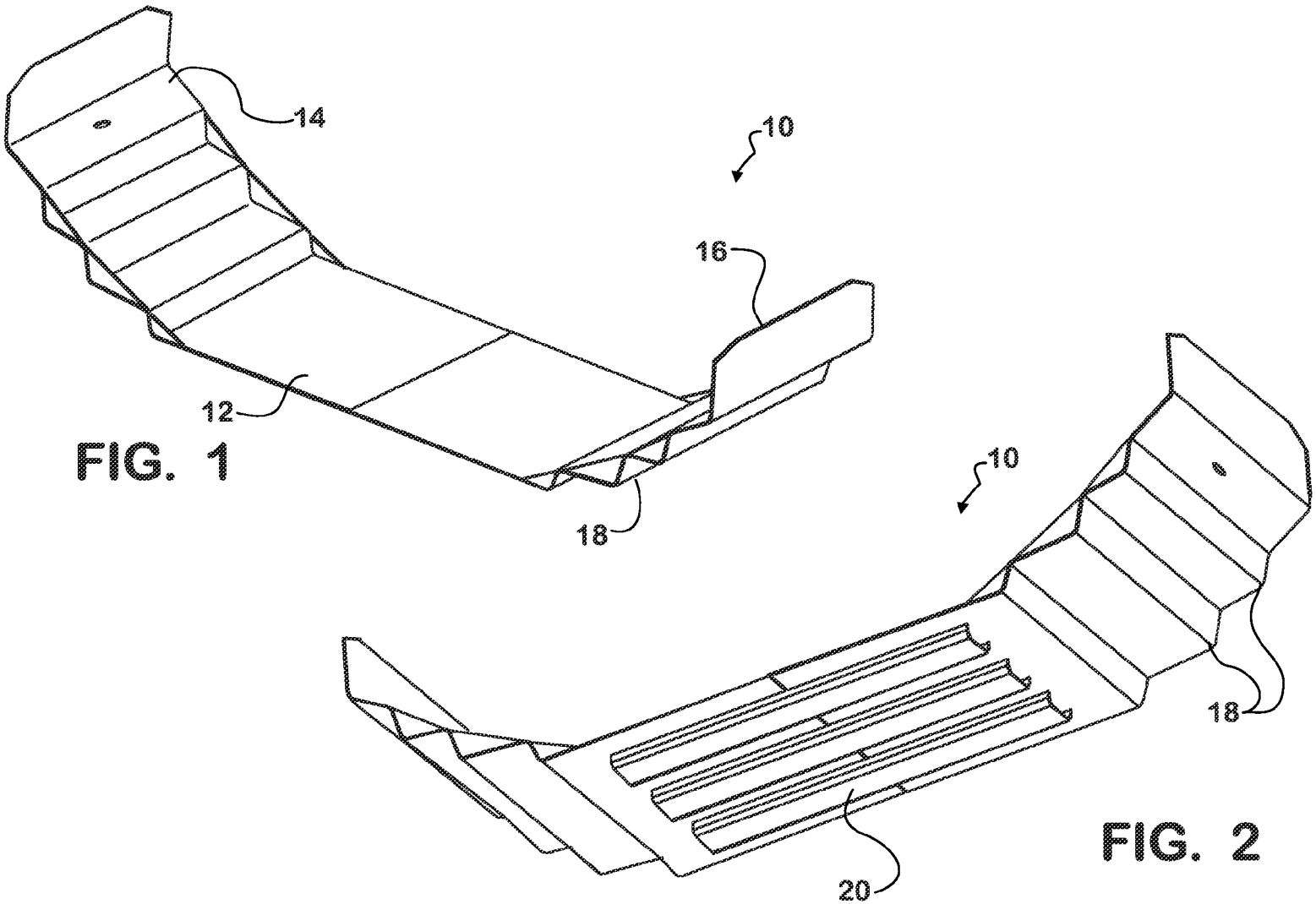
FIG. 1 is a perspective view of the blast absorbing flexing structure of the present disclosure.
FIG. 2 is a bottom perspective view of one embodiment of the blast absorbing flexing structure.
Figure 3:
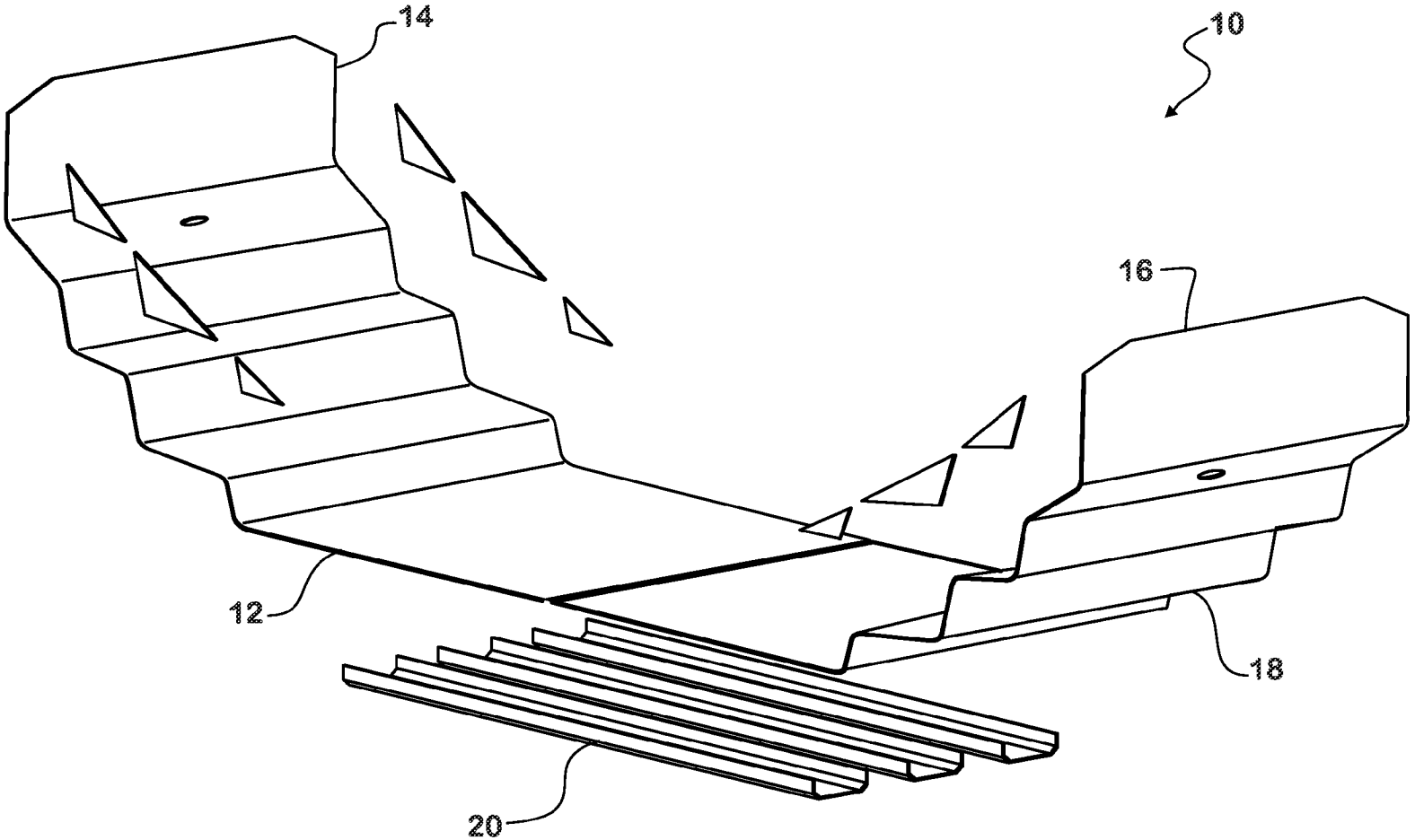
FIG. 3 is an exploded perspective view of the blast absorbing flexing structure.
Figure 7:
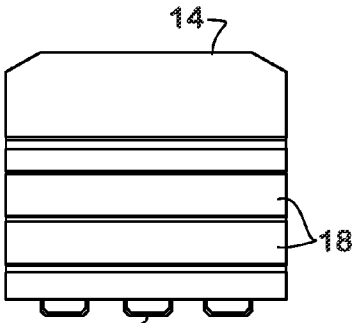
FIG. 7 is an end view of the blast absorbing flexing structure.
Figure 4:
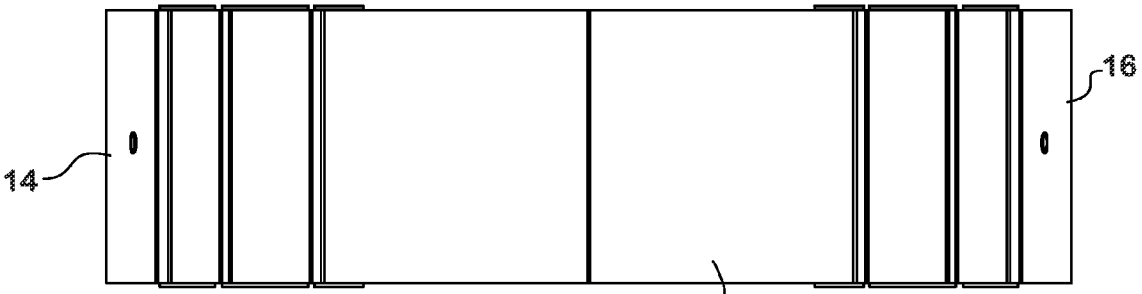
FIG. 4 is a top view of the blast absorbing flexing structure.
Figure 5:
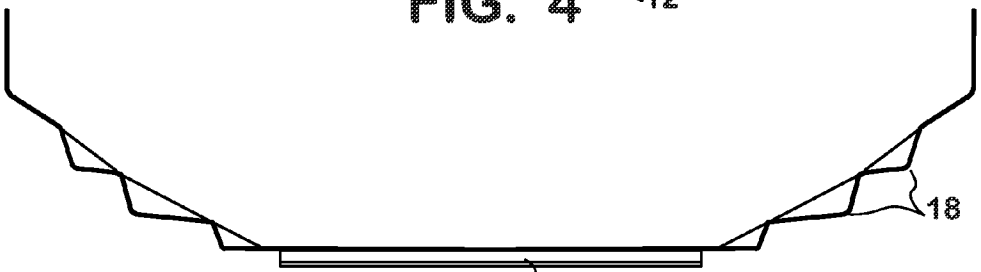
FIG. 5 is a side view of the blast absorbing flexing structure.
Figure 6:
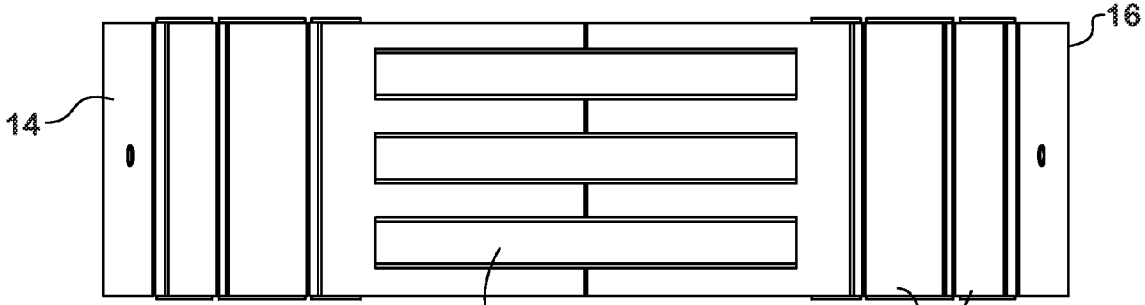
FIG. 6 is a bottom view of the blast absorbing flexing structure.

FIGS. 2 and 3 illustrate a series of supports 20, which are positioned underneath the cabin floor. The supports 20 run the length of the bottom section 12, and provide further reinforcement to the bottom section, both during normal use and during blast use. Although three supports 20 are illustrated, it should be understood that any number of supports can be used in the present application.

The bottom 12 and side sections 14, 16 and the supports 20 of the blast energy absorbing structure 10 can be constructed from a variety of material, including, but not limited to steel, aluminum, aluminum honeycomb, and any variety of plastics and composites of the same. Construction of the sections and associated personnel cabin can be accomplished by known methods of construction.

As illustrated in FIGS. 8*a*-*b* and 9*a*-*b*, the side sections 14, 16 work together to lessen in impact of a blast on the lower extremities of the occupants of the vehicle. In particular, immediately after an explosive blast, all of the components naturally move in an upward direction. In particular, the side sections 14, 16 through their ridges or steps 18, flex upon receiving the blast energy thereby dissipating the force of the blast before it reaches the vehicle occupants. It is the accelerated, upward movement of the floor structure during a blast that can cause catastrophic injuries to the lower extremities. However, in the present disclosure, the energy absorbing structure 10 flexes in response to the blast energy reaching the floor thus lessening the impact of the blast on the lower extremities of the occupants.

Figure 10:
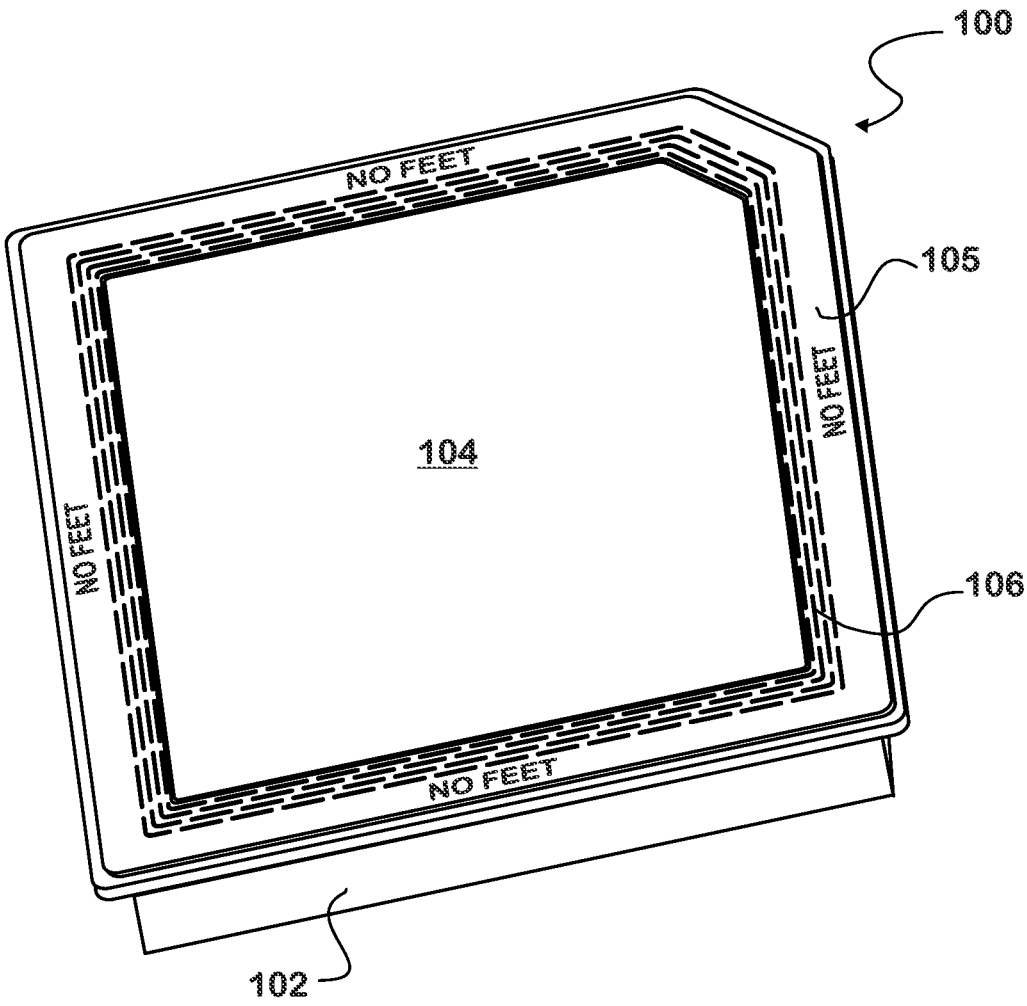
FIG. 10 is a perspective view of another embodiment of the blast absorbing expanding structure.
Figure 11:
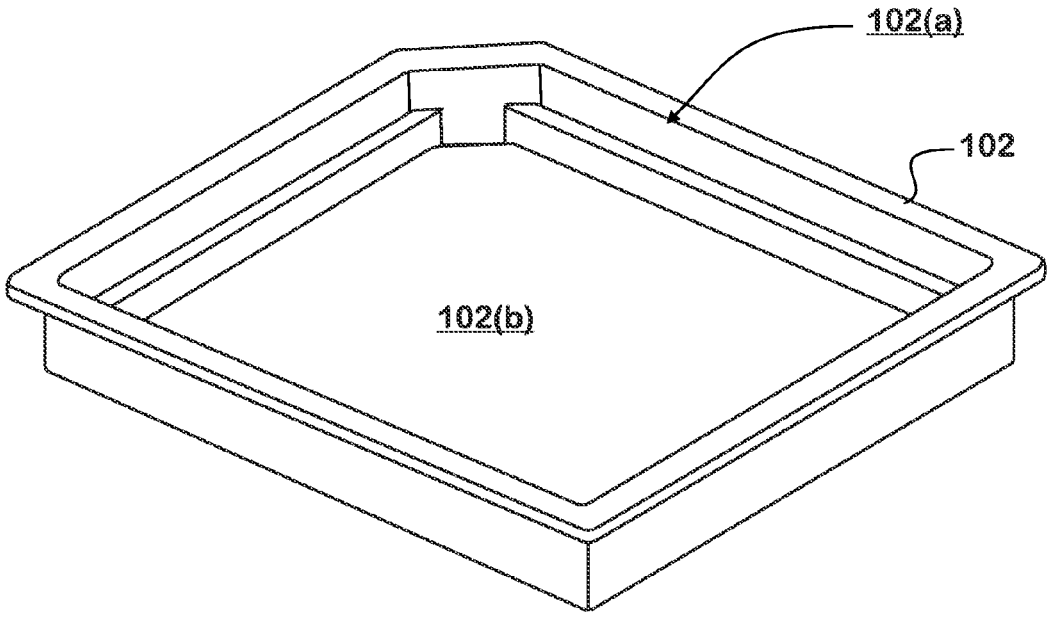
FIG. 11 is a perspective view of the box or shell of the blast absorbing expanding structure.
Figure 12:
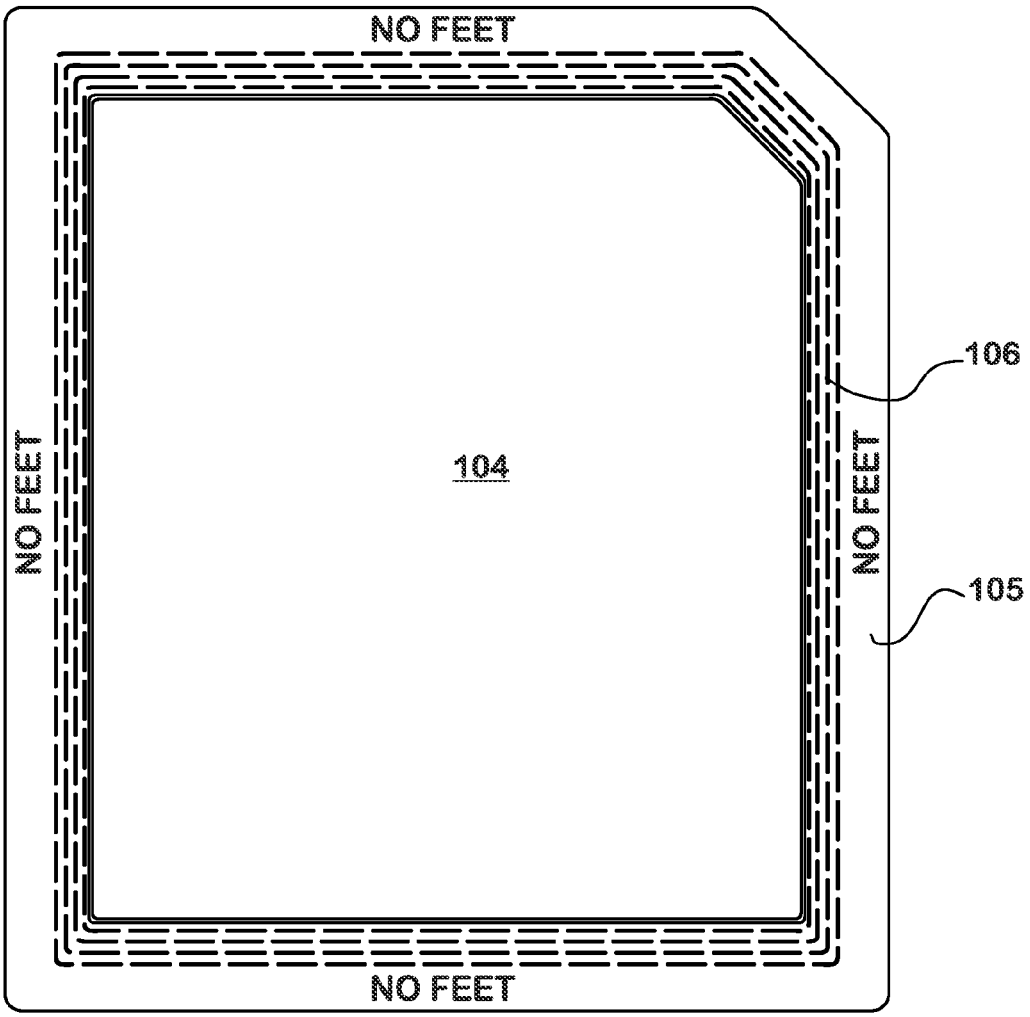
FIG. 12 is a perspective view of the cover plate secured to the blast abatement device of the blast absorbing expanding structure.

FIGS. 10-12 illustrate another embodiment of a blast energy absorbing structure, specifically a blast absorbing expanding structure 100. In addition, FIGS. 13*a*-13*d* show the blast absorbing expanding structure 100 in sequence from a pre-blast or neutral position, to a post-blast or activated position. The blast absorbing expanding structure 100 includes a blast abatement device 102, having an open top 102(*a*) and a solid bottom 102(*b*), which forms the floor of the cabin. The structure 100 also includes a cover plate or protective panel 104, which includes a plurality of slots 106 generally cut around the perimeter 105 of the plate in the area where the occupants of the cabin do not place their feet. However, it should be understood that the location of the slots 106 does not have to be limited to the perimeter 105 of the plate or panel.

Figure 13A:
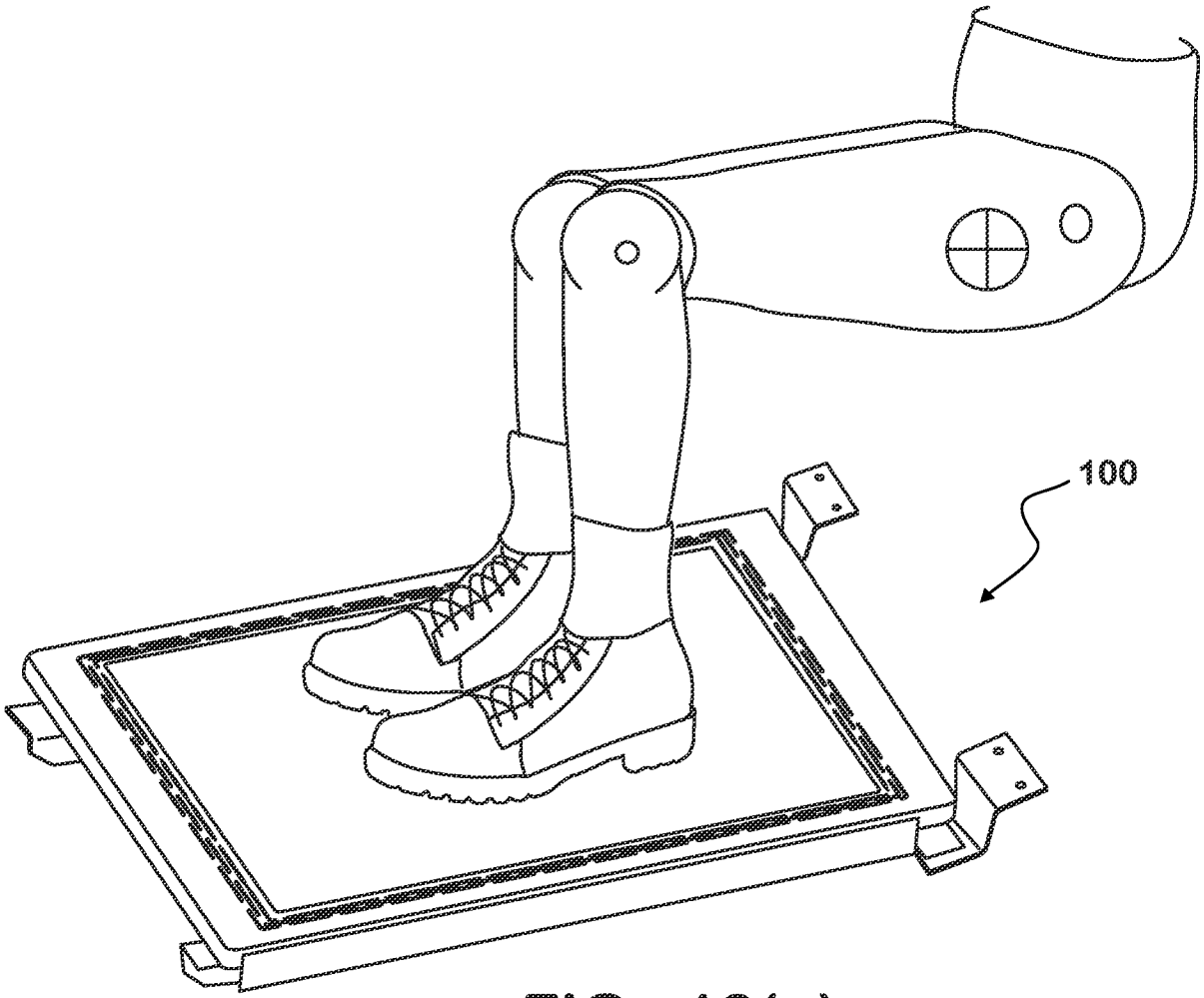
FIGS. 13(*a*) through (*d*) show the blast absorbing expanding structure movement from a pre-blast position (*a*) through a post-blast (*d*) position; and, FIG. 14 is a top view of the box of the blast absorbing expanding structure containing energy absorbing supports.
Figure 13B:
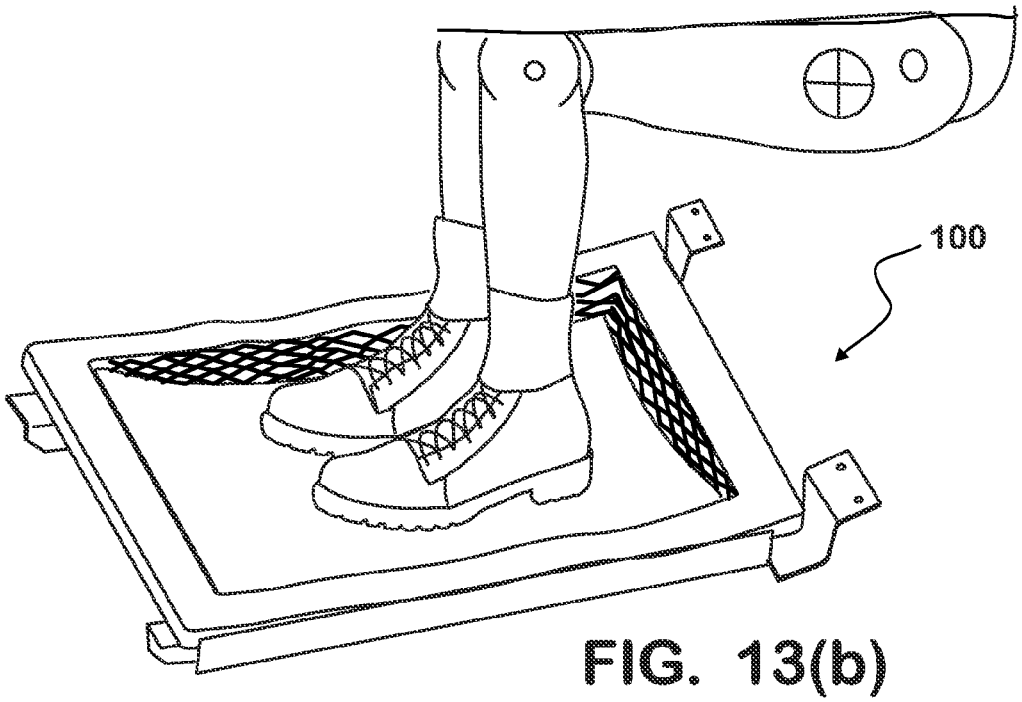
Figure 13C:
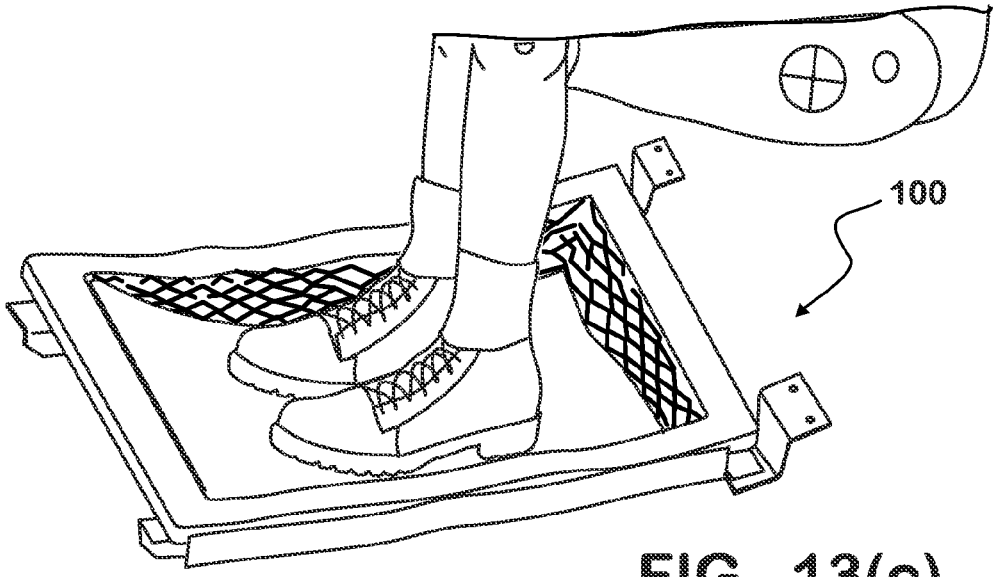
Figure 13D:
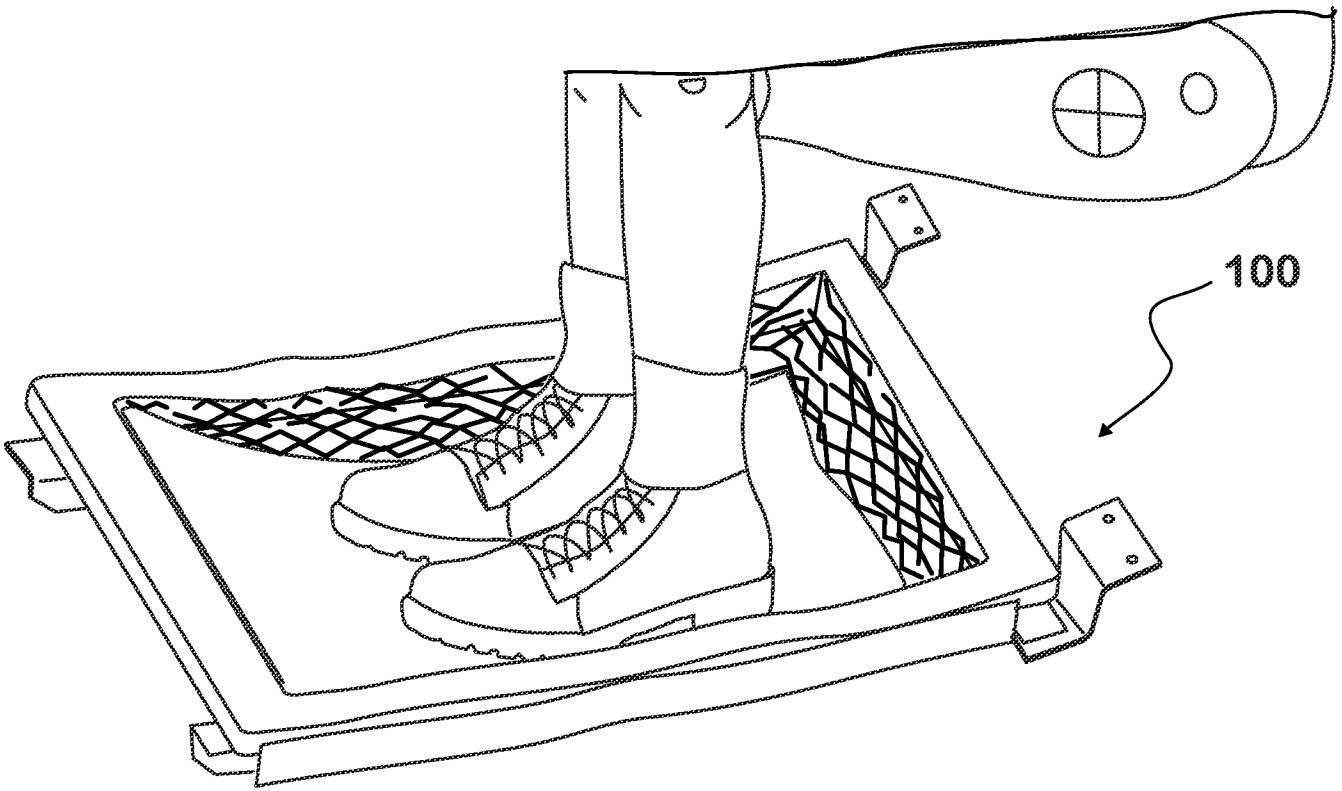

As shown in FIGS. 12 and 13*a*-13*d*, the slots 106 act to dissipate the energy from the blast and permit the cover plate or protective panel 104 to move or "stretch" upon application of a blast force. The sequence of movement of the cover plate or panel 104 upon application of a blast force from the neutral, pre-blast position is shown in FIG. 13*a* through the post-blast position of FIG. 13*d*. Specifically, FIGS. 13*b*-13*d* illustrate the sequence of the range of downward expansion of the plate or panel 104 when exposed to blast energy. In addition, by varying the number of rows of slots 106 within the plate 104, the range of expansion or movement of the plate can also change, depending on the vehicle and conditions.

The blast abatement device 102 and cover plate or panel 104 of the blast energy expanding structure 100 may be constructed from a variety of material, including, but not limited to steel, aluminum, aluminum honeycomb, and any variety of plastics and composites of the same. Construction of the components and the associated personnel cabin can be accomplished by known methods of construction.

Figure 14:
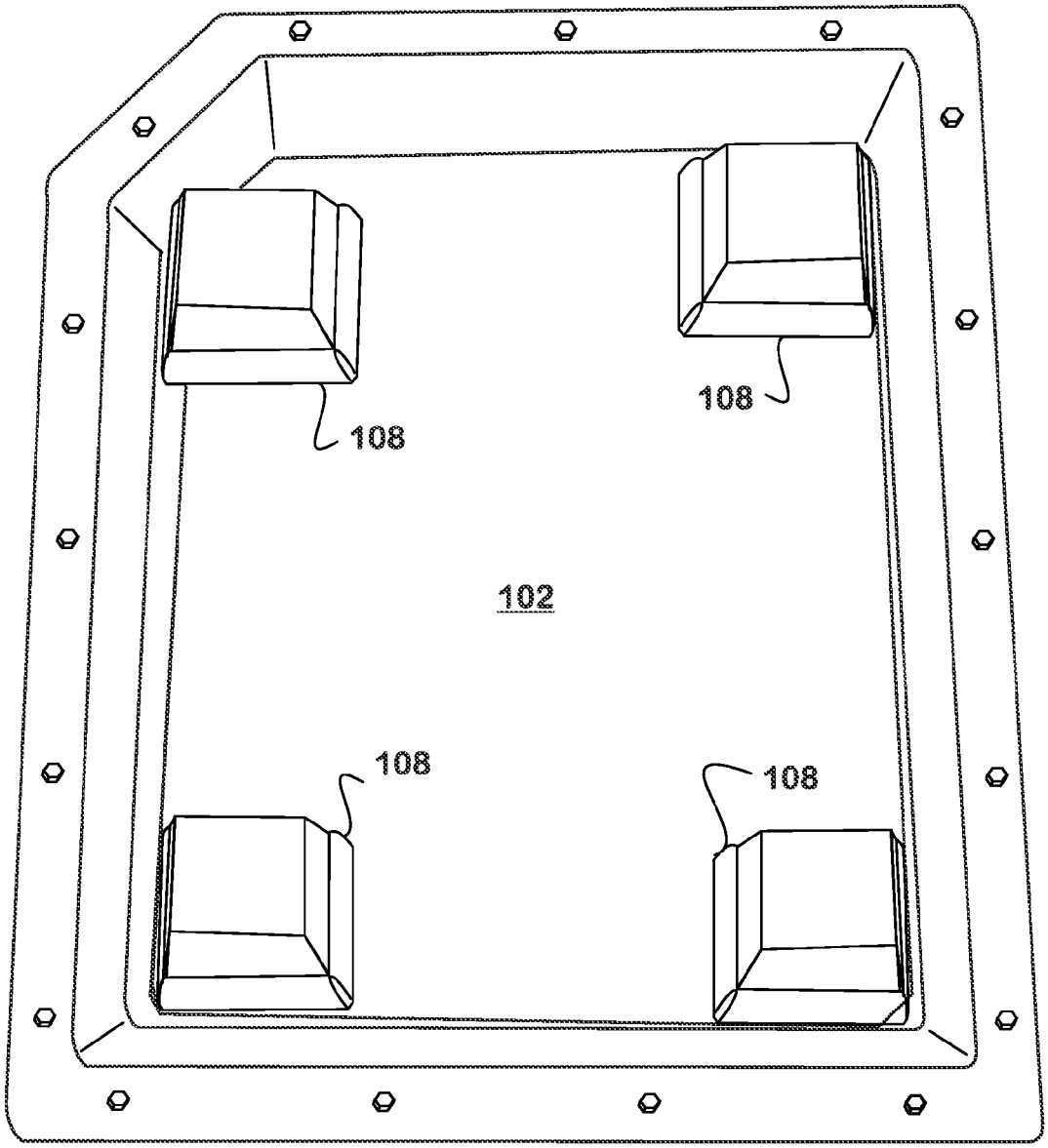

As shown in FIG. 14, the structures 10, 100 may include at least one energy absorbing support 108. Although the present disclosure includes four supports, one at each corner of the blast abatement device 104, it should be understood that any number of supports may be used. Additionally, the energy absorbing support 108 may have any suitable shape, including but not limited to that of a pillar, square or rectangle or a triangle or tapered side shape. The energy absorbing support 108 can be secured through any suitable fastener device including, but not limited to screws, bolts or studs. Optionally, the supports 108 may be integrated into the lower floor structure of the cabin.

The energy absorbing support 108 may be constructed from any suitable material such as a foamed material, including, but not limited to foamed aluminum, aluminum honeycomb, synthetic foams, such as polystyrene and/or polyethylene, other plastics, etc. Regardless of the material used for the supports, the material must be able to both support the normal walking loads (for example, a 300 pound load spread over a foot pressure representative area results in a deflection characteristic of existing production vehicle floors) and within a common specified working temperature range (−50° F. to 160° F.). Finally, the material must progressively crush during a blast load.

In operation, and as described, the various components of the blast absorbing structures and system 10, 100 work separately and in conjunction to dissipate at least some of the energy exerted on the underbelly of a vehicle cause by, for example, the explosion of an IED below the vehicle. In various exemplary embodiments, when an IED, or similar explosive device, is detonated below the vehicle, the force of the explosion causes the lower floor structure 12 of the vehicle to deform. This deformation in turn forces the floor against the lower extremities of any occupants of the vehicle. The blast absorbing system deforms and slows the upward motion of the force to help dissipate the force being exerted on the lower extremities of the occupants, thereby reducing the likelihood of injury to the occupants.

It should be appreciated that the above-referenced forces may include general deformation forces, localized deformation forces, general displacement forces, localized displacement forces, or any other force that may be exerted upon the underbelly of a vehicle.

It should also be appreciated that, while the above discussion is related to deformation forces caused by, for example, IED explosions, the disclosed embodiments may be usable to dissipate other forces, such as, for example, blunt forces impacts, grenade detonations, small arms fire, and any other force that may be exerted upon the underbelly of a vehicle.

What is claimed is:

1. A blast absorbing flexing structure for use in absorbing blast force energy exerted on an underside of a personnel cabin of a vehicle, the structure comprising:

a bottom section forming a floor of the cabin;

a first side section extending from the bottom section, the first side section having a plurality of steps along a length of the side section, each of the plurality of steps vertically progressing to another step;

a second side section extending from the bottom surface and opposite to the first side section, the second side section having a plurality of steps along a length of the second side section, each of the plurality of steps vertically progressing to another step; and, wherein the bottom section and side sections form an absorption component cooperatively moveable between an initial position and a blast force position to diminish the blast forces reaching an occupant of the cabin, wherein the bottom and side sections form an interior of the vehicle.

2. The blast absorbing flexing structure of claim 1, wherein the side sections flex in response to a blast force exerted on the underside of the vehicle.

3. The blast absorbing flexing structure of claim 1, wherein the structure further includes at least one energy absorbing support.

4. The blast absorbing flexing structure of claim 3, wherein the energy absorbing support receives an initial blast force exerted on the underside of the vehicle.

5. The blast absorbing flexing structure of claim 4, wherein the energy absorbing support deforms in response to the initial blast force.

* * * * *